US007181888B1

(12) United States Patent
Facaros

(10) Patent No.: US 7,181,888 B1
(45) Date of Patent: Feb. 27, 2007

(54) INTERCONNECTED DOUBLE HULL CONSTRUCTION FOR BASEMENTS

(76) Inventor: George Facaros, 1714 Palm Valley Dr. West, Harlingen, TX (US) 78552

( * ) Notice: Subject to any disclaimer, the term of this patent is extended or adjusted under 35 U.S.C. 154(b) by 0 days.

(21) Appl. No.: 11/361,745

(22) Filed: Feb. 23, 2006

Related U.S. Application Data

(60) Provisional application No. 60/759,223, filed on Jan. 12, 2006.

(51) Int. Cl.
*E02D 19/00* (2006.01)

(52) U.S. Cl. ..... 52/169.5; 52/506.06

(58) Field of Classification Search ..... 52/506.6, 52/794.1, 796.1, 272, 274, 169.5, 30
See application file for complete search history.

(56) References Cited

U.S. PATENT DOCUMENTS

| | | | | | |
|---|---|---|---|---|---|
| 405,794 | A | * | 6/1889 | O'Donnel | 52/317 |
| 1,693,655 | A | * | 12/1928 | Murphy | 52/402 |
| 1,980,906 | A | * | 11/1934 | Bretland | 52/506.06 |
| RE26,239 | E | * | 7/1967 | Rockabrand et al. | 52/403.1 |
| 3,424,647 | A | * | 1/1969 | O'Connor et al. | 442/324 |
| 3,445,322 | A | * | 5/1969 | Saiia et al. | 428/178 |
| 3,518,800 | A | * | 7/1970 | Tank | 52/480 |
| 3,903,671 | A | * | 9/1975 | Cuin et al. | 52/480 |
| 4,114,335 | A | * | 9/1978 | Carroll | 52/336 |
| 4,422,271 | A | * | 12/1983 | Anzinger | 52/302.1 |
| 4,574,541 | A | * | 3/1986 | Raidt et al. | 52/169.5 |
| 4,745,716 | A | * | 5/1988 | Kuypers | 52/169.5 |
| 4,843,786 | A | * | 7/1989 | Walkinshaw et al. | 52/169.5 |
| 4,943,185 | A | * | 7/1990 | McGuckin et al. | 405/45 |
| 4,956,951 | A | * | 9/1990 | Kannankeril | 52/169.5 |
| 5,263,792 | A | * | 11/1993 | Davis et al. | 405/45 |
| 5,551,797 | A | * | 9/1996 | Sanford | 405/36 |
| 5,775,039 | A | * | 7/1998 | McPherson | 52/169.5 |
| 5,857,297 | A | * | 1/1999 | Sawyer | 52/169.5 |
| 6,098,364 | A | * | 8/2000 | Liu | 52/506.08 |
| 6,755,001 | B2 | * | 6/2004 | Eaton | 52/506.06 |
| 6,854,228 | B2 | * | 2/2005 | Arseneau et al. | 52/309.9 |
| 6,973,756 | B2 | * | 12/2005 | Hatzinikolas | 52/235 |
| 2002/0139068 | A1 | * | 10/2002 | Janesky | 52/169.5 |
| 2005/0198916 | A1 | * | 9/2005 | Janesky | 52/169.5 |
| 2005/0247021 | A1 | * | 11/2005 | Schauffele | 52/782.1 |

* cited by examiner

*Primary Examiner*—Jeanette Chapman
*Assistant Examiner*—Jessica Laux
(74) *Attorney, Agent, or Firm*—Robert E. Howard

(57) ABSTRACT

An interconnected double hull construction for the basement of a building. The double hull construction includes a plurality of interior wall boards attached to the interior face of the foundation walls in a manner adapted to provide communication between air passageways located behind the wall boards and the ambient air within the basement. A plurality of secondary floor slabs are placed over the primary floor slab. A plurality of spacer members located between the primary floor slab and the secondary floor slabs are adapted to provide a plurality of interconnecting passageways. An air exhaust system is adapted to draw ambient air from within the basement through the air passageways and/or through the plurality of interconnecting passageways and exhaust the air from the structure. Sump pump means are provided for gathering water from within the basement and exhausting the water from the building.

13 Claims, 3 Drawing Sheets

INTERCONNECTED DOUBLE HULL CONSTRUCTION FOR BASEMENTS

CROSS-REFERENCE TO RELATED APPLICATIONS

This application claims the benefit of U.S. Provisional Application No. 60/759,223, filed Jan. 12, 2006.

BACKGROUND OF THE INVENTION

The present invention relates to an interconnected double hull construction for basements that provides insulation, waterproofing, and quality air.

In many parts of the world structures are built with basements. Building codes for basement construction varies from country to country, and from state to state within the United States.

In spite of good construction methods, materials and design, basements can become damp or wet. Such dampness problems can arise from cracks created by settling of the structure, by clogged drain lines, etc. Insulated walls are difficult to keep dry, resulting in mold and mildew growth, odors, and rotting. During wet periods basements with water leaks are vulnerable to excessive water seepage and condensation that can damage the insulation, flooring, and finished walls. Many insulated basements cannot handle minor water flooding or condensation without damage to the insulation.

Poor air quality is another problem arising in many basement. In some areas of the country radon gas can seep into basements from the adjacent ground. Homes today tend to be well insulated and airtight, giving rise to an accumulation of internally polluted air from a variety of sources.

SUMMARY OF THE INVENTION

It is an object of the present invention to provide a basement construction that thermally insulates the basement without causing rotting, mildew, mold, or odors.

It is a further object of the present invention to provide a basement construction that protects the basement from large and small water leaks, and moisture or condensation that can penetrate the walls or floor.

It is a still further object of the present invention to provide a basement construction that removes radon and/or other air pollutants.

The present invention relates to an interconnected double hull construction for a basement located beneath a structure. Such basements include a primary horizontal floor slab, vertical foundation walls, and a ceiling attached to horizontal floor joists.

A plurality of interior wall boards are attached to the interior face of the vertical foundation walls of the basement. Each of the interior insulation wall boards have a rigid insulation core having a front face and a rear face. A plurality of substantially vertical slats or other spacing means are located on the rear face thereof. The interior wall boards are attached to the interior face of the vertical foundation walls with the spacing means in contact therewith. The spaces between adjacent slats or spacing means provide a plurality of passageways for air, water vapor, radon and air pollutants. The interior wall boards are attached to the foundation walls in a manner adapted to provide communication between their air passageways and the ambient air within the basement.

A plurality of secondary floor slabs are placed over the primary horizontal floor slab. A plurality of spacer members are located between the primary horizontal floor slab and each of the secondary floor slabs. The spacer members are adapted to provide a plurality of interconnecting passageways between the primary and secondary floor slabs.

An air exhaust system, including an air duct containing a motor driven fan, draws ambient air from within the basement through the air passageways behind the interior insulation wall boards and/or through the plurality of interconnecting passageways located between the primary and secondary floor slabs, and exhausts it from the structure.

The double wall and double floor creates interconnected space for removing liquid water, water vapor, radon, and air pollutants.

A sump pump means for gathering water from within the basement and exhausting it from the structure is provided.

Exterior insulation wall boards are attached to the exterior face of the vertical foundation walls.

DESCRIPTION OF PREFERRED EMBODIMENTS

Figure 1:
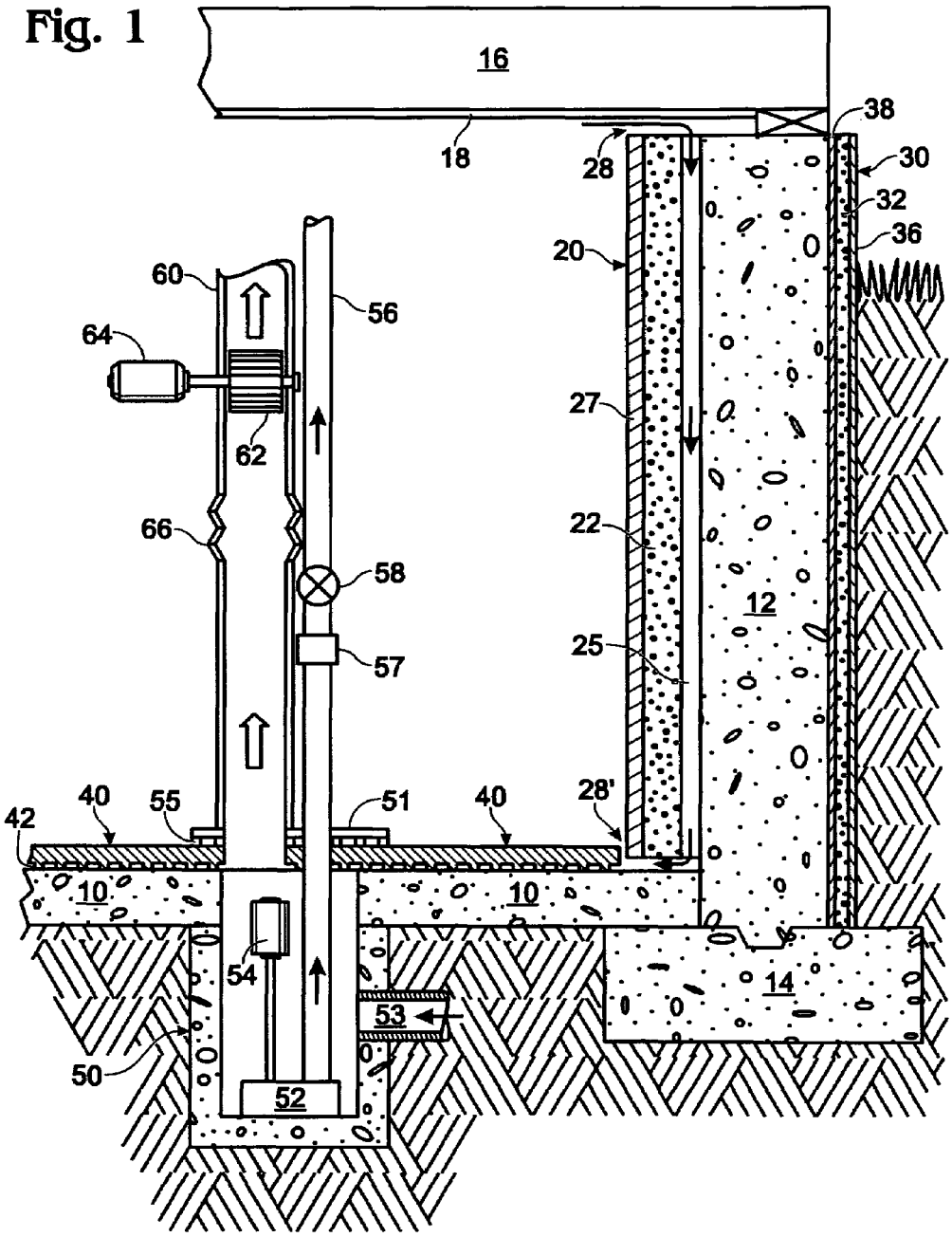
FIG. 1 is a fragmentary cross-sectional view of the double hull basement construction of the present invention.

Conventional basement construction includes a horizontal concrete "primary" floor slab 10, vertical foundation walls 12 formed of concrete, concrete blocks, etc. resting on a concrete footing 14, floor joists 16, and a ceiling 18 attached to floor joists 16.

Figure 2:
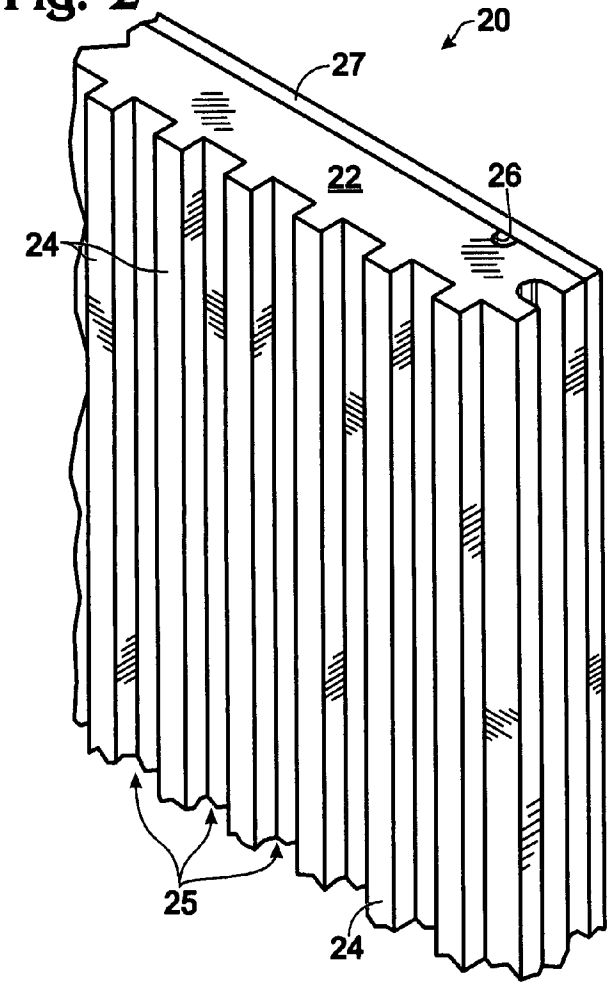
FIG. 2 is a rear perspective view of the rigid interior wall board assembly used in the double hull basement construction.

Interior wall boards 20 are attached to the interior face of vertical concrete foundation walls 12. As best seen in FIG. 2, interior wall boards 20 include a rigid insulation core body 22. A plurality of substantially vertical spacing slats 24 are located on the rear face of interior wall boards 20 for providing a plurality of spaces 25 between adjacent slats or spacing means to provide a plurality of passageways for air, water vapor, radon, and air pollutants. Slats 24 also provide surfaces for gluing interior wall boards 20 to the interior face of vertical concrete foundation walls 12. Spacing slats 24 can be continuous or discontinuous.

Spacing members other than spacing slats 24, such as spacer members 42 discussed below, can be used so long as they allow air, water vapor, radon, and air pollutants to pass between interior wall boards 20 and foundation walls 12. Spacing slats 24 or other spacing members can be attached to the foundation wall 12 instead of to the rear of interior wall boards 20.

Vertical wiring tunnels 26 can be formed at various locations within wall boards 20 to provide space for running electrical, telephone, or cable TV wires, or plumbing. Horizontal or angular wiring tunnels (not shown) can also be formed in wall boards 20.

A hard facing board 27 is attached to the front face of rigid insulation core body 22 of interior wall boards 20. Facing board 27 can be water resistant with a pre-finished pattern or paintable. Facing board 27 can be made from sheet rock, concrete, stucco, pre-finished wood paneling, or similar materials.

When interior wall boards 20 are applied to the interior face of vertical concrete foundation walls 12, space 28 is left between the top thereof and ceiling 18 so that the air passageways formed between adjacent vertical slats 22 communicate with the interior space of the basement. Space 28' is left between the bottom thereof and the upper surface of primary floor slab 10 so that air and water can enter therethrough.

Interior wall boards 20 can have cut-outs to accommodate windows or obstructions.

Interior wall boards 20 are preferably rectangular in shape, and of a size to allow for easy handling.

Figure 3:
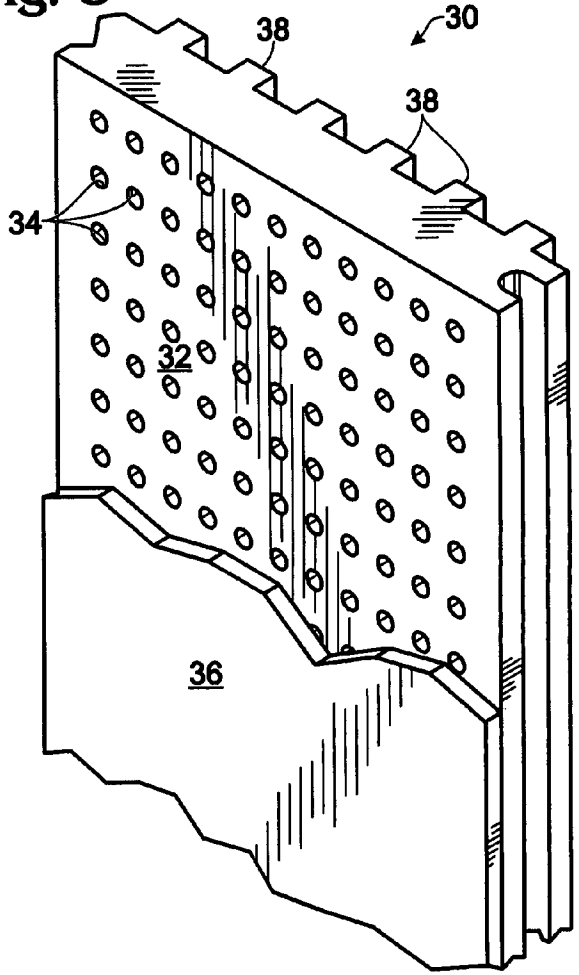
FIG. 3 is a front perspective view of the rigid exterior wall board assembly used in the double hull basement construction.

Exterior wall boards 30 are attached to the exterior face of vertical concrete foundation walls 12. As best seen in FIG. 3, exterior wall boards 30 include a rigid insulation core body 32 having a plurality of small, shallow adhesion holes 34 located in the exterior face thereof.

A protective coating 36 forms the exterior face of exterior boards 30. Protective coating 36 can be any protective coating used on the exteriors of basement walls, such as various plasticized materials, cement, stucco, or similar materials. Adhesion holes 34 improves the adhesion of the protective coating 36 to exterior wall boards 30. Instead of adhesion holes 34, grooves or other means can be used to improve the adhesion of protective coating 36.

A plurality of substantially vertical slats 38 are located on the interior face of exterior wall boards 30. Slats 38 are used to adhere exterior boards 30 to foundation walls 12 with an adhesive, such as "liquid nails". Slats 38 can be formed into the interior face of exterior boards 30, or can be separate parts that are adhered to the interior face of exterior boards 30. The top openings between the slats 38 should be sealed with an all weather sealant.

Figure 4:
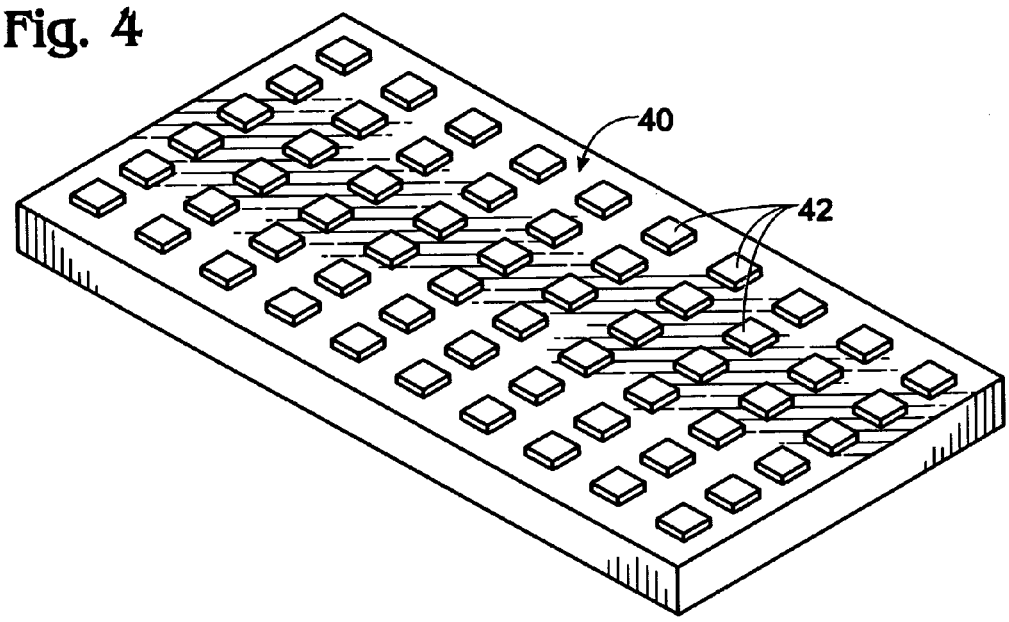
FIG. 4 is a bottom perspective view of a first embodiment of a secondary floor slab used in the double hull basement construction.

Secondary floor slabs 40, as shown in FIGS. 1 and 4, are placed on top of the existing (primary) basement floor slab 10. Secondary floor slabs 40 can be rectangular or square and of a size adapted to provide for easy handling. A plurality of spacer members 42 are attached to the underside of secondary floor slabs 40 or, alternatively, attached to the existing basement floor slab 10. Spacer members 42 are shown as having a rectangular shape, but they can be other shapes. Spacer members 42 provide for interconnecting air and water spaces between existing basement floor slab 10 and secondary floor slabs 40, as best seen in FIG. 1. Secondary floor slabs 40 with attached spacer members 42 can be made from concrete and attached to the existing floor slab 10 with outdoor tile mortar or similar material.

Figure 5:
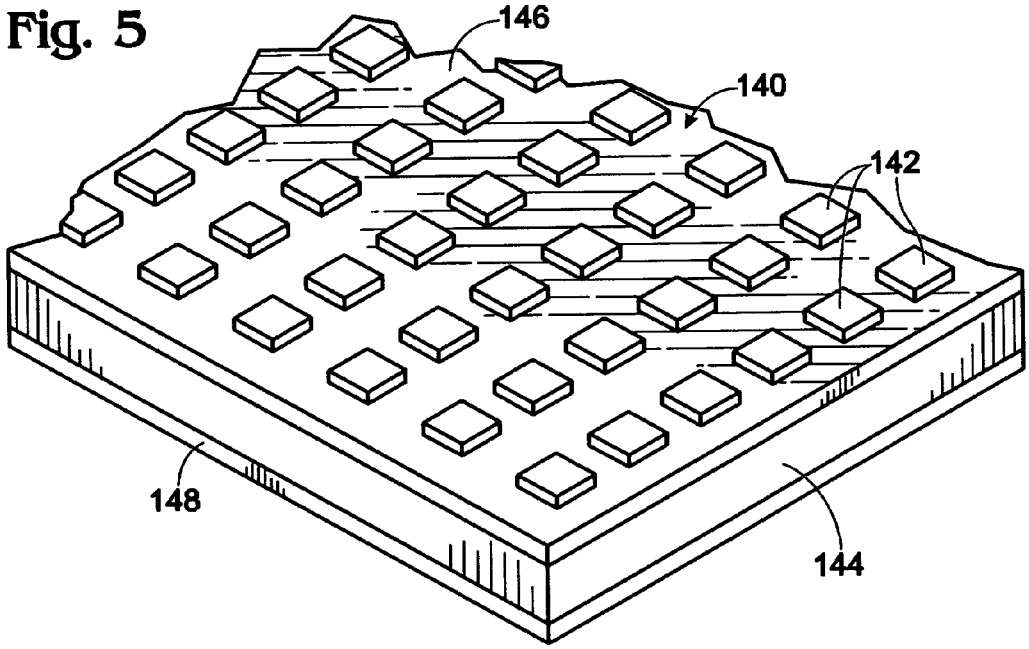
FIG. 5 is a bottom perspective view of a second embodiment of a secondary floor slab used in the double hull basement construction.

An alternative secondary floor slab 140 is shown in FIG. 5. Secondary floor slab 140 has a core of rigid insulation material 144. A plastic laminate layer 146 attached to the underside of core 144. A plurality of spacer members 142 are attached to the outside surface of plastic laminate layer 146. An outer layer 148 of hard waterproof material is attached to the upper side of core 144.

A sump pit 50 is formed beneath primary basement floor slab 10 in a manner well known in the art, and has a removable sump pit cover 51 having a plurality of bottom spacers 55, or a perforated perimeter seal (not shown). A sump pump 52 powered by electric sump pump motor 54 is installed within sump pit 50 in a manner well known in the art. Collected water from one or more drain pipes 53 (only one drain pipe 53 being shown) and from along wall 12 and floor 10 enters sump pit 50. Drain pipes 53 are connected at their other ends to suitably placed floor drains (not shown). The output of sump pump 52 is connected to exhaust water pipe 56 having a disconnect fitting 57 and one way valve 58. The output end of water pipe 56 (not shown) is connected to an external drain system or to the outside of the structure.

An air exhaust system includes an exhaust air pipe 60 having an exhaust fan 62 located therein powered by variable speed electric motor 64 controlled by a humidistat. Exhaust air pipe 60 is preferably mounted on sump pit cover 51. A flexible disconnect 66 allows access to the interior of exhaust pipe 60. The output end of exhaust air pipe 60 (not shown) is located on the exterior of the building, such as above the roof.

In operation, motor driven exhaust fan 62 is turned on and draws ambient basement air into the space 28 adjacent the ceiling 18, and down through the spaces 25 located between vertical slats 22 of interior wall boards 20. The direction of the flow of air in the air exhaust system is shown by the non-solid arrows in FIG. 1. The ambient air is drawn downwardly into the interconnecting spaces provided by spacer members 42 located between the upper surface of concrete floor slab 10 and the lower surface of secondary floor slab 40. Air is also drawn into the space 28' located between secondary floor slabs 40 and interior insulation assembly boards 20. The air, water vapor, radon, and pollutants are then drawn into exhaust air pipe 60 and exhausted to the exterior of the structure.

The water exhaust system allows water to flow from floor drains into drain pipes 53, and into sump pit 50 where it is pumped out by sump pump 52. The sump pump 52 will also remove the water that enters sump pit 40 from the air space created at the wall 12 and on the floor 10. The air flow in the air space created at the wall 12 and the floor 10 will dry any dampness to prevent the formation of mold and mildew. Any radon gas or other pollutants coming through drain pipes 53 will also be removed by the air exhaust system. The direction of the flow of water in the water exhaust system is shown by the solid arrows in FIG. 1.

In addition, water accumulating on the floor not captured by floor drains can enter the space 28' located between secondary floor slabs 40 and interior insulation assembly boards 20, through the spaces provided by spacer members 42 located between the upper surface of concrete floor slab 10 and the lower surface of secondary floor slab 40, and into sump pit 50. Also, water accumulating on the floor not captured by floor drains and not entering space 28' can flow into sump pit 50 through the space provided by the spacers 55 located on the bottom of removable sump pit cover 51.

Filtered make up air can be provided at convenient entry areas in the structure. Preferably the make up air would be passed through a heat exchanger associated with the exhaust air pipe 60 to assist in heating or cooling such make up air.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A basement construction comprising:

a primary horizontal floor slab, vertical foundation walls having an interior face and an exterior face, and a ceiling attached to horizontal floor joists;

a plurality of interior wall boards attached to the interior face of said foundation walls, each of said interior wall boards having a front face and a rear face, a plurality of wall board spacer members located between said rear face of said interior wall boards and said foundation walls, said wall board spacer members adapted to provide a plurality of air passageways in the space between said rear face of said interior wall boards and said foundation walls, said interior wall boards being attached to said foundation walls in a manner adapted to provide communication between said air passageways and ambient air within said basement;

a plurality of secondary floor slabs overlying said primary horizontal floor slab, each of said secondary floor slabs being made of concrete and having an under side and an upper side;

a plurality of secondary floor slab spacer members located between said primary horizontal floor slab and said under side of said secondary floor slabs, said secondary floor slab spacer members being formed of concrete and adapted to provide a plurality of interconnecting passageways;

an air exhaust system adapted to draw ambient air from within said basement through said air passageways and/or through said plurality of interconnecting passageways and exhaust said air from said building; and sump pump means for exhausting water from said basement.

2. The basement construction of claim 1 wherein each of said interior wall board includes a rigid insulation core body.

3. The basement construction of claim 2 wherein said wall board spacer members are a plurality of slats.

4. The basement construction of claim 3 wherein said wall board spacer members are a plurality of substantially vertically disposed slat.

5. The basement construction of claim 4 wherein said slats are attached to the rear face of each of said interior wall boards.

6. The basement construction of claim 2 wherein a facing board forms the front face of each of said interior wall boards.

7. The basement construction of claim 1 wherein said secondary floor slab spacer members are attached to the underside of each of said secondary floor slabs.

8. The basement construction of claim 7 wherein said secondary floor slab spacer members are substantially rectangular in shape.

9. The basement construction of claim 1 including a plurality of exterior wall boards attached to the outer surface of said foundation walls, each of said exterior wall boards having an exterior face and an interior face.

10. The basement construction of claim 9 wherein each of said exterior wall boards has a rigid insulation core body.

11. The basement construction of claim 10 wherein each of said exterior wall boards has a protective coating forming the exterior face thereof.

12. The basement construction of claim 11 wherein each of said exterior wall boards has a plurality of slats located on the interior face thereof.

13. The basement construction of claim 12 wherein said slats are substantially vertically oriented.

* * * * *